United States Patent [19]

Aldinio et al.

[11] Patent Number: 4,574,500

[45] Date of Patent: Mar. 11, 1986

[54] FOOT RETAINING DEVICE PARTICULARLY FOR SKI BOOTS

[75] Inventors: Giuseppe Aldinio, Treviso; Giorgio Baggio, S. Martino di Lupari; Mariano Sartor, Montebelluna, all of Italy

[73] Assignee: Nordica S.p.A., Montebelluna, Italy

[21] Appl. No.: 510,748

[22] Filed: Jul. 5, 1983

[30] Foreign Application Priority Data

Jul. 22, 1982 [IT] Italy ..... 22497/82[U]

[51] Int. Cl.[4] ..... A43B 5/04; A43C 11/00

[52] U.S. Cl. ..... 36/119; 36/117; 24/68 SK

[58] Field of Search ..... 36/117, 119, 121, 77 R, 36/120; 24/68 SK

[56] References Cited

U.S. PATENT DOCUMENTS

| | | | |
|---|---|---|---|
| 3,175,310 | 3/1965 | MacQuaid | 36/77 R |
| 3,808,644 | 5/1974 | Schoch | 24/68 SK |
| 4,222,184 | 9/1980 | Kastinger | 36/121 |
| 4,426,796 | 1/1984 | Spademan | 36/119 |
| 4,433,456 | 2/1984 | Baggio | 24/68 SK |

FOREIGN PATENT DOCUMENTS

| | | | |
|---|---|---|---|
| 891063 | 9/1953 | Fed. Rep. of Germany | 36/119 |
| 2712001 | 9/1977 | Fed. Rep. of Germany | 36/119 |
| 2399811 | 4/1979 | France | 36/119 |
| WO80/02789 | 12/1980 | PCT Int'l Appl. | 36/119 |
| WO81/01645 | 6/1981 | PCT Int'l Appl. | 36/121 |

*Primary Examiner*—Henry S. Jaudon
*Assistant Examiner*—Steven N. Meyers
*Attorney, Agent, or Firm*—Guido Modiano; Albert Josif

[57] ABSTRACT

A foot retaining device in a ski boot comprises a pressure element arranged within an outer shell of the ski boot at the neck area of the user's foot, and a cable embracing the pressure element and having one end fixed to the outer shell and another end wound on a winding reel operable by a knob accessible from the outside of the ski boot. The reel and knob are arranged at a rear portion of the ski boot. Rotation of the winding reel causes the pressure element to increase or decrease pressure on the user's foot. Ratchet gears are provided for retaining the winding reel and cable in position in use.

2 Claims, 3 Drawing Figures

FOOT RETAINING DEVICE PARTICULARLY FOR SKI BOOTS

BACKGROUND OF THE INVENTION

This invention relates to a foot retaining device particularly for ski boots.

Currently available on the market are ski boots which are provided internally with pressure elements acting on the wearer's foot such as to hold the foot securely inside the ski boot.

Such pressure devices are generally actuated through a large variety of arrangements, such as levers, screws, cables, or the like, the operation whereof is generally complicated and above all not always enables continuous adjustment to achieve accurate positioning of the pressure element to meet contingent requirements.

SUMMARY OF THE INVENTION

It is an object of this invention to remove such prior limitations by providing a retaining device which, through the utilization of a cable winding assembly disclosed in a prior U.S. Pat. No. 4,433,456 incorporated hereto for reference purposes, can afford continuous and accurate adjustment capabilities for the pressure elements.

Another object of this invention is to provide a retaining device, wherein disengagement of the pressure elements can be effected in a most rapid manner and through easy movements of the user.

It is a further object of the invention to provide a foot retaining device, which allows accurate and secure tightening of the pressure element, thus contributing significantly to the user's own safety while skiing.

These and other objects, such as will be apparent hereinafter, are achieved by a foot retaining device particularly for ski boots, according to the invention, comprising, within the outer shell of a ski boot, a pressure element positioned at the neck area of the user's foot, characterized in that said pressure element is acted upon by a cable attached to one end to a fixed point on the boot shell, and at the other end to a winding reel actuatable from the outside of said shell.

BRIEF DESCRIPTION OF THE DRAWINGS

Further features and advantages will be more readily apparent from the following detailed description of a foot retaining device particularly for ski boots, as illustrated by way of example and not of limitation in the accompanying drawing, wherein.

DESCRIPTION OF THE PREFERRED EMBODIMENTS

Figure 1:
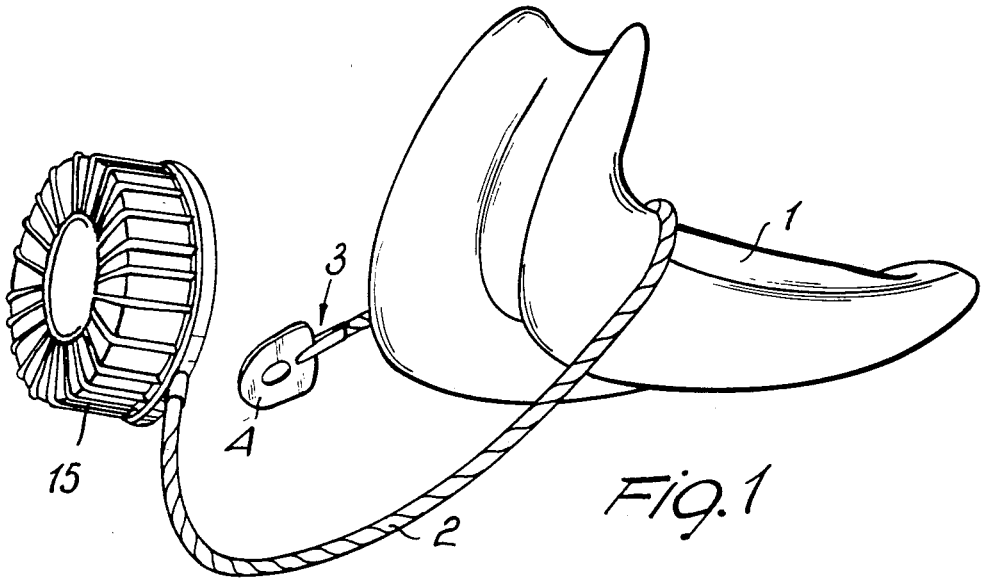
FIG. 1 shows schematically and in perspective the retaining device of this invention.
Figure 2:
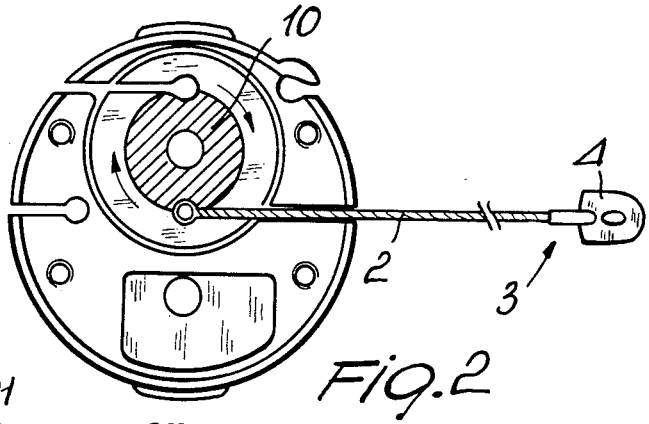
FIG. 2 shows, partly in section, the cable winding reel.
Figure 3:
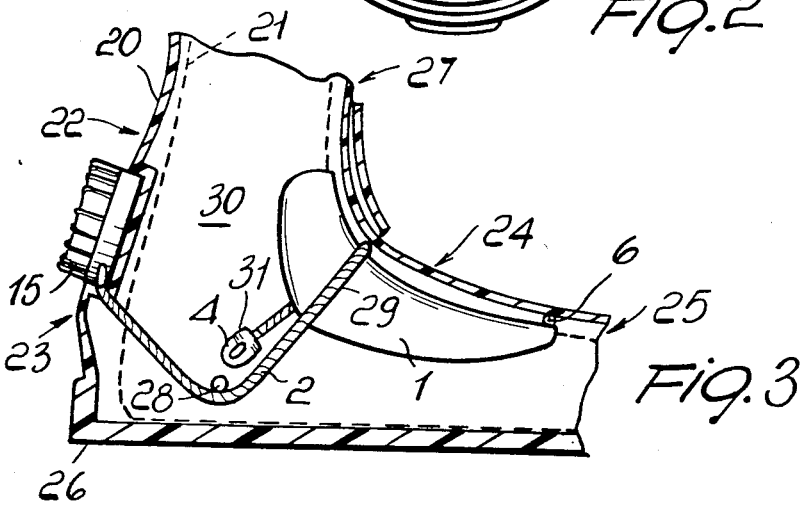
FIG. 3 shows, partly cut-away, this retaining device as positioned inside a ski boot.

Making reference to the drawing figures, this foot retaining device particularly for ski boots comprises a pressure element, generally designated with the reference numeral 1, which is formed from a substantially rigid material and has a substantially angled configuration, having a lower face whose configuration substantially matches that of the foot region where it is positioned, namely the region of the foot neck.

The pressure element 1 is positioned inside the boot shell 20, and preferably externally to the conventional soft inner shoe 21 which is inserted into a ski boot 22. The boot shell 20 has a rear portion 23, an instep portion 24 and a front portion 25, as well as a sole 26. The boot has a leg portion 27 and side portions 30.

To effect the actuation of the retaining device, there is provided a small cable 2 which runs with a length 29 thereof above the pressure element 1, crosswise with respect to its longitudinal lay.

The cable 2 is provided at one end thereof, indicated at 3, with an eyelet 4 for anchoring it to a fixing point 31 located inside the boot shell and positioned at a side portion of the boot at the bottom of the area accommodating the cited pressure element i.e. at a level nearer to the sole 26 than the pressure element 1.

At the other end, the cable 2 is connected to a winding reel mechanism 10, of a type disclosed in the aforesaid U.S. Pat. No. 4,433,456 which is located outside of the shell indicated at 20.

More specifically, the reel mechanism 10 includes an actuation portion in the form of a knurled knob 15 for being rotated thereby, which knob is advantageously located on the rear portion of the ski boot and allows, through linkages which will not be described in detail herein because fully explained in the cited patent, the reel 10 to be rotated, so that the cable 2 is wound therearound, and to be locked by suitable ratchet gears within the device allowing an accurate retention in place of the reel 10 and cable 2.

The cable winding device employed also allows quick releaase, when it is desired to reduce the pressure exerted by the pressure element.

Advantageously, the cable 2 is run over pulleys 29 or the like means which are provided on the inner side of the boot shell, oppositely to where the free end 3 of the cable 2 is secured to the shell in the fixing point 31.

It should be further added that, advantageously, the cited pressure element 1 is associated, at its front end, with a hinge 6 for connection to the shell 20, it being thus allowed to pivot about a horizontal axis transverse to the main or longitudinal extension of the sole of the user's foot.

It occurs, consequently, that the pressure element 1 will turn about the hinge 6 to effect a highly effective retention of the foot and such as to inflict no pain or discomfort on the user.

The retaining device according to this invention is extremely simple to use. In fact, the user only is to operate the knob 15 to cause the cable 2 to wind itself around the reel 10 such that, by changing the useful length of the cable, it tends to apply a downwardly directed compression of the pressure element 1, which will thus act on the user's foot neck to hold it firmly in place.

Once a desired pressure force is reached, by releasing the knob 15 one can be assured of its remaining firmly in place.

To release the device, it will be sufficient to operate the knob 15 in the opposite direction, thus causing the cable 2 to unwind itself quickly from the reel 10 with attendant release of the pressure exerted by the pressure element 1.

It should be appreciated from the foregoing description that the invention achieves its objects, and in particular, that the retaining device of this invention is extremely fast to actuate, easy to operate, and such as to provide an accurately applied retentive action by the pressure element.

In practicing the invention, the materials used, if compatible with the specific intended use, and the dimensions and contingent shapes, may be any selected ones to meet individual requirements.

We claim:

1. A foot retaining device for ski boots having a longitudinal extension, an outer shell including an instep portion of the boot, a leg portion, a front portion and side portions thereof, the device comprising a pressure element arranged inside to said outer shell at the area of said instep portion thereof, said pressure element conforming to the shape of the instep and having one end portion facing the leg portion of the boot and another end portion facing the front portion of the boot and an intermediate portion between said one end portion and said another end portion, hinge means on said shell near said another end portion of said pressure element for hingedly connecting said pressure element to said shell at said another end portion thereof, said hinge means defining an axis of rotation extending transverse to the longitudinal extension of the ski boot, a winding reel mechanism attached on said shell and having at least one actuate portion thereof arranged at the outside of said shell, a cable-like member embracing said pressure element at said intermediate portion thereof and connected with at least one end thereof to said winding reel mechanism, guide means for said cable-like member, thereby to displace said pressure element inwardly with respect to said shell upon actuation of said winding reel mechanism.

2. A foot retaining device for ski boots having a longitudinal extension, a sole, an outer shell including an instep portion of the boot, a leg portion, a front portion, a rear portion and side portions thereof and an inner shoe within said ski boot, the device comprising a pressure element arranged between said outer shell and said inner shoe at the area of said instep portion of the boot, said pressure element conforming to the shape of the instep and having one end portion facing the leg portion of the boot and another end portion facing the front portion of the boot and an intermediate portion between said one end portion and said another end portion, hinge means on said shell near said another end portion of said pressure element for hingedly connecting said pressure element to said shell at said another end portion thereof, said hinge means defining an axis of rotation extending transverse to the longitudinal extension of the ski boot, a winding reel mechanism attached on said shell at said rear portion thereof and having at least one actuation portion thereof arranged at the outside of said shell, a cable-like member embracing said pressure element, guide means for said cable-like member, said cable-like member having a first length thereof overlying said pressure element and extending transverse to said longitudinal extension, said cable-like member having one end thereof connected to said winding reel mechanism and another and thereof fixed in a fixing point on one of said side portions of said shell, said fixing point being at a level nearer to the sole than said pressure element, said guide means comprising a guide member fixed on an opposite one of said side portions in a position opposite to said fixing point thereby to determine the transverse extension of said first length of said cable-like member, thereby upon actuation of said winding reel mechanism said pressure element is displaced towards the boot inside by a swinging movement about said axis of rotation of said hinge means.

* * * * *